United States Patent [19]

Goeman

[11] 4,359,849

[45] Nov. 23, 1982

[54] INSULATED WALL CONSTRUCTION HAVING A CLIP AND FASTENER THEREIN

[75] Inventor: Friedrich Goeman, Stone Mountain, Ga.

[73] Assignee: W. R. Bonsal Company, Lilesville, N.C.

[21] Appl. No.: 187,739

[22] Filed: Sep. 16, 1980

[51] Int. Cl.[3] ..... E04B 1/38

[52] U.S. Cl. ..... 52/479; 52/309.4; 52/DIG. 6

[58] Field of Search ..... 52/309.4, 483, 363, 52/464, 467, 468, 460, 461, 712, 713, DIG. 6; 411/466, 484; 403/306, 387

[56] References Cited

U.S. PATENT DOCUMENTS

| | | | |
|---|---|---|---|
| 1,691,179 | 11/1928 | Betz | 52/467 |
| 2,307,348 | 1/1943 | Anderson | 52/363 |
| 2,334,406 | 11/1943 | Gray | 411/484 |
| 2,339,841 | 1/1944 | Deuchler et al. | 52/483 |
| 2,919,621 | 1/1960 | Langdon | 52/363 |
| 2,937,418 | 5/1960 | Sanford | 411/483 |
| 3,304,106 | 2/1967 | McCormack | 411/487 |
| 3,417,651 | 12/1968 | Moehlenpah | 411/466 |
| 3,417,652 | 12/1968 | Menge | 411/466 |
| 3,447,823 | 6/1969 | Gregoire | 411/466 |
| 3,449,997 | 6/1969 | Couch | 411/466 |
| 3,498,171 | 3/1970 | Jureit | 411/466 |

*Primary Examiner*—Price C. Faw, Jr.

*Attorney, Agent, or Firm*—Bell, Seltzer, Park & Gibson

[57] ABSTRACT

An insulated wall construction having a substrate defining a wall surface, compressible insulation board positioned over the wall surface of the substrate and a specifically designed clip and fastener for securing the insulation board to the substrate. The clip includes a generally flat plate for providing a bearing surface against the compressible insulation board and a plurality of prongs extending outwardly from the plate for partially penetrating the insulation board for securing the clip to the insulation board. An elongate fastener passes through a central aperture in the clip and is of greater length than the thickness of the insulation board for penetrating through the insulation board and into the substrate for securing the insulation board to the substrate, while being restrained by the clip from undesired compression of the insulation board.

5 Claims, 4 Drawing Figures

INSULATED WALL CONSTRUCTION HAVING A CLIP AND FASTENER THEREIN

FIELD OF THE INVENTION

This invention relates to an insulated wall construction having a substrate defining a wall surface, compressible insulation board positioned over the wall surface of the substrate, and a specially designed clip and fastener for securing the insulation board to the substrate, while restraining undesired compression of the insulation board.

BACKGROUND OF THE INVENTION

Insulated wall or roof constructions of the type in which compressible insulation boards, particularly formed plastic material, are positioned over a wall surface of a substrate, such as an outside or inside wall surface of a masonry, metal, or wooden stud wall, have suffered from problems with respect to suitable mechanical fasteners for securing the insulation board to the substrate.

Conventional mechanical fasteners utilized in such wall constructions have primarily consisted of nail or screw-type fasteners which are simply driven through the insulation boards and into the substrate for securing the insulation boards to the substrate. These types of fasteners present problems when securing compressible insulation boards to substrates inasmuch as the usual head on these types of screw or nail fasteners presents a very minimum bearing surface in contact with the insulation boards. As a result, the fasteners are often driven too far into the insulation boards or the insulation board later buckles from environmental conditions, both resulting in undesired compression, deformation or stress of the insulation boards causing a weakness in the securement of the insulation boards to the substrate.

Although washers or clips have been heretofore proposed for use with fasteners, particularly in roofing construction and the like, such clips or washers are usually specifically designed for the particular use and are not readily adaptable for use in securing compressible insulation boards to a substrate wall.

The above problems become more acute when, as is the usual case, a plurality of insulation boards are to be secured to a substrate wall at areas of butted edges of the insulation boards, which are often placed over a stud in the substrate wall. In these situations, a fastener has to be used for each insulation board and must be placed at a certain required distance from the edge of the insulation boards, which results in weakness in the securement of the insulation boards to the substrate since the fasteners may be too close to the edges of the stud.

SUMMARY OF THE INVENTION

With the foregoing in mind, it is the object of this invention to provide a clip and fastener suitably securing compressible insulation board to a wall surface of a substrate, while restraining undesired compression of the insulation board by the fastener.

It has been found by this invention that the above object may be accomplished by providing a clip constructed of a generally flat plate positioned with one face contiguous to the outer face of the insulation board and being of predetermined dimensions for providing a bearing surface against the compressible insulation board. The clip further includes a plurality of prongs extending generally perpendicularly outwardly from the face of the plate in engagement with the insulation board and being of a predetermined length less than the predetermined thickness of the insulation board and partially penetrating the insulation board for securing the clip to the insulation board.

An elongate fastener is provided which has a head on one end thereof of less dimensions than the plate, which is of a predetermined length greater than the predetermined thickness of the insulation board, and which extends through a central aperture in the clip and generally perpendicularly outwardly from the face of the plate in engagement with the insulation board. The fastener head is restrained on the other side of the plate and the fastener penetrates through the insulation board and into the substrate for securing the insulation board to the substrate, while being restrained by the clip from undesired compression of the insulation board by the increased bearing surface provided by the clip.

In a wall construction in which a plurality of insulation boards are utilized and are butted together along outside edges thereof, the clip and fastener are positioned at the butted edges of the insulation board. The clip spans such butted edges and the prongs of the clip partially penetrating the insulation boards for connecting the insulation boards together. The fastener passes through the butted edges and into the substrate for securing the insulation boards to the substrate, while being restrained by the clip from undesired compression of the insulation boards. This arrangement eliminates the necessity for and problems associated with plural fasteners and reduces the number of fasteners required.

BRIEF DESCRIPTION OF THE DRAWINGS

Some of the objects and advantages of this invention having been set forth, other objects and advantages will be apparent with the following more specific description when taken in conjunction with the accompanying drawings, in which.

DESCRIPTION OF THE ILLUSTRATED EMBODIMENT

Figure 1:
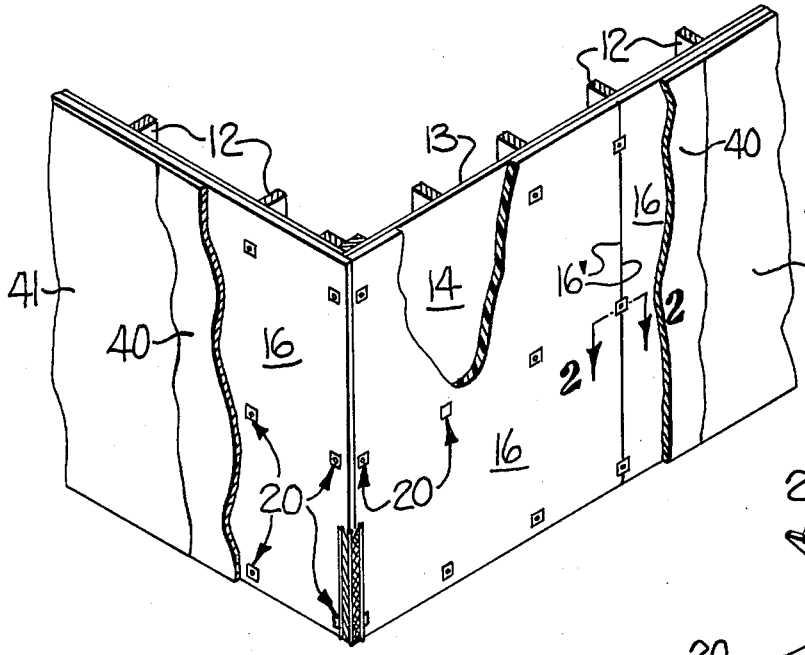
FIG. 1 is a perspective view of one wall construction of the type set forth by this invention with portions thereof broken away.

In FIG. 1 there is illustrated one form of insulated wall construction, generally indicated at 10, constructed in accordance with this invention. As may be seen in this view, the insulated wall construction 10 includes a substrate in the form of generally vertically extending, spaced apart, parallel, wooden studs 12 having sheathing 13 attached thereto and defining an outside wall surface 14. However, it is to be understood that this substrate 12, 13 forming an outside wall surface 14 could comprise any type of existing or new, inside or outside, substrate wall or roof construction including masonry walls, metal buildings, roofing sheaths etc. Accordingly, the term "substrate defining a wall surface" as used herein is intended to cover all such wall or roof constructions.

The insulated wall construction 10 further includes compressible insulation boards 16, which are preferably of a compressible foamed plastic material, more particularly expanded polystyrene foam. This type of insulation board normally has a compression strength of between approximately 10 to 60 psi. However, these insulation boards 16 could be of other materials. The insulation boards 16 are preferably butted together along outside edges 16' thereof and positioned over the wall surface 14 of the substrate 12, 13 with one face of the insulation boards 16 contiguous to the wall surface of the substrate. It is conventional to position the butted edges 16' of the insulation boards 16 at the area of a wooden stud 12 in this type of construction.

The insulated wall construction 10 further includes clips 20, which comprise a generally flat plate 21 positioned with one face thereof contiguous to the other face of the insulation board 16. The clips 20 are generally positioned at the areas of the wooden studs 12 in this type of substrate construction and for those areas in which butted edges 16' of insulation boards 16 are placed at the area of studs 12, the plate 21 spans the butted edges 16' of the insulation boards 16. The flat plate 21 is of predetermined dimensions for providing a bearing surface against the compressible insulation boards 16.

A plurality of prongs 22 extend generally perpendicularly outwardly from one face of the plate 21 and are of predetermined length less than the predetermined thickness of the insulation boards 16. The prongs 22 partially penetrate the insulation boards 16 for securing the clips 20 to the insulation boards 16. In the situation where a clip 20 is placed over and spans butted edges 16' of two insulation boards 16, the prongs 22 partially penetrate the insulation boards 16 for connecting the insulation boards 16 together through the clip 20.

The clip 20 may further include a centrally positioned aperture 23 therein which may be preformed or may be formed by penetration of a fastener, to be discussed below, through the clip 20.

Figure 3:
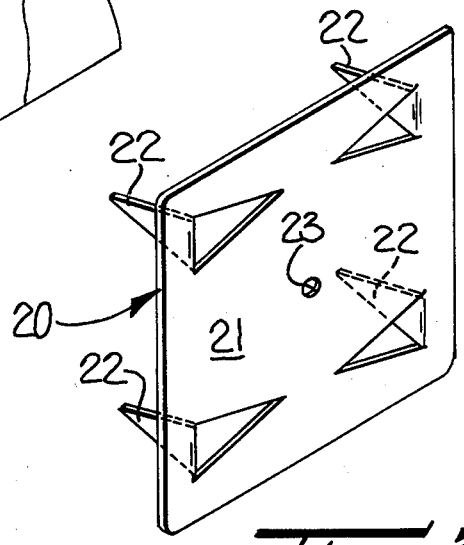
FIG. 3 is an enlarged perspective view of one embodiment of a clip to be utilized with a fastener in the wall construction in accordance with this invention.
Figure 4:
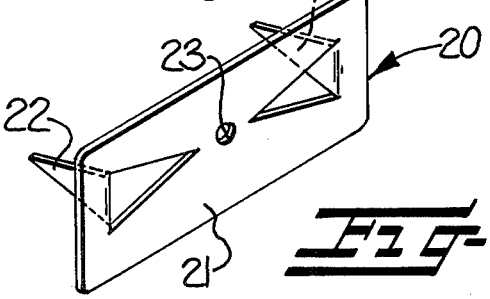
FIG. 4 is a view, like FIG. 3, of an alternate embodiment of such clip.

The clip 20 is preferably constructed of galvanized sheet metal or other non-corrosive materials, such as stainless steel, cold rolled steel, aluminum, plastic pvc, etc. The prongs 22 may be formed from the plate 21 and may be of a generally triangular configuration. The prongs 22 are preferably cut along two sides thereof from the plate 21 and bent outwardly from the plate 21 along the third side which remains attached to the plate 21. Preferably, the plate is of generally rectangular configuration and there may be four of the prongs 22 respectively positioned generally in corner portions of the plate 21, as shown in FIG. 3, or there may be only two prongs 22 respectively positioned outwardly of the central aperture 23 along a central axis through the flat plate 21, as shown in FIG. 4. Other configurations and arrangements of prongs are possible for the clip 20.

Figure 2:
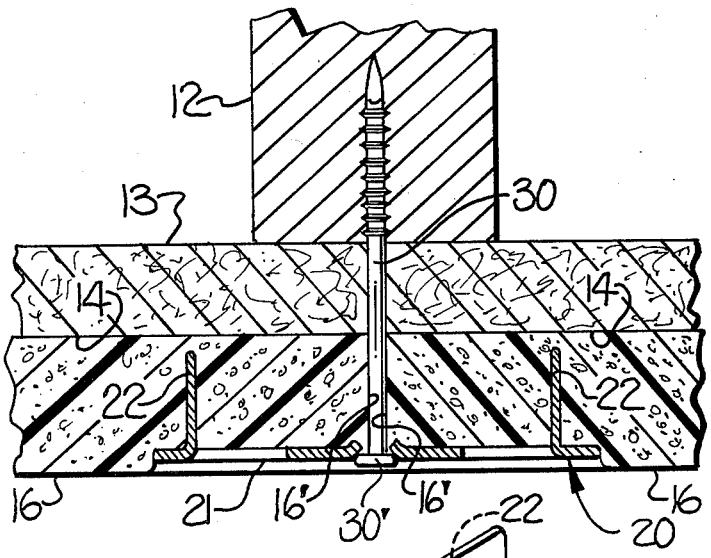
FIG. 2 is an enlarged sectional view, taken generally along the line 2—2 of FIG. 1.

The insulated wall construction 10 further includes an elongate fastener 30, of the nail or screw type, having a head 30' on one end thereof of less dimensions than the plate 21 of the clip 20 and of greater dimensions than the aperture 23 in the plate 21. The fastener 30 is of a predetermined length greater than the predetermined thickness of the insulation boards 16 and extends through the aperture 23 and generally perpendicularly outwardly from the one face of the plate 21 with the fastener head 30' being retained on generally the outer face of the plate 21. The fastener 30 penetrates through the insulation boards 16 and into the substrate 12, 13 for securing the insulation boards 16 to the substrate 12, 13 while being restrained by the clip 20 from undesired compression of the insulation boards 16 by the increased bearing surface created by the clip 20 over that which would be present by the head 30' of the fastener 30 alone. Some slight compression of the insulation boards 16 may at times be desired for slightly countersinking the clip 21 and fastener 30, as shown in FIG. 2, so that an outside coating may be placed over the insulation boards 16 and the clip 20 and fastener 30, as described below.

It is preferable that the predetermined length of the fastener 30 be at least $\frac{3}{8}$ inch to $\frac{3}{4}$ inch greater than the predetermined thickness of the insulation boards 16 for both masonry and wooden stud wall substrate constructions.

A typical thickness of insulation board 16 is 1 inch with $\frac{3}{4}$ inch being the thinnest recommended and the prongs 22 of the clip 20 are preferably of $\frac{5}{8}$ inch length. When assembled with insulation boards of this thickness, the prongs 22 will also aid in preventing undesired compression of the insulation boards 16 by the clip 20 and fastener 30 through the prongs 22 abutting the substrate 12, 13 upon slight compression of the insulation boards 16 and preventing further compression of the insulation boards 16.

When expanded polystyrene foam is used as the insulation board 16, such foam usually has a low compression strength of approximately only 14 psi. A conventional nail or screw-type fastener 30 could have a head 30' as large as $\frac{3}{8}$" diameter which would provide a surface area of less than 0.11 square inch as a bearing surface against the insulation board, if the clip 20 were not used, since part of the surface area is consumed by the shank of the fastener 30. Therefore, a force of less than $1\frac{1}{2}$ pounds would cause undesired compression or deformation of the insulation board 16 by the fastener 30.

When utilizing a clip 20 with a fastener 30, the minimum bearing surface area of the clip 20 depends on the expected loads on the insulation board 16 from dead weight or from external sources, such as wind loads, movement in the structure or substrate, etc. The length of the clip 20 must be sufficient to span two butted edges 16' of the insulation boards 16 and must place the prongs 22 at least $\frac{3}{8}$" away from the butted edges 16' of each board 16. Accordingly, a length of 1" is minimal.

By experimentation, when utilizing insulation boards having a compression strength of between 10 to 60 psi, it has been found that the clip 20 should have a bearing surface of more than 1 square inch and at least 5 times that of the bearing surface which would be provided by conventional headed fastener 30. More particularly, it has been found that suitable dimensions for a commercial embodiment of a clip 20 would include a length of approximately $2\frac{3}{8}$" and a width of approximately $1\frac{5}{8}$" for the four-prong clip 20 of FIG. 3. This would result in a surface area forming a bearing surface of approximately 3.859 square inches. This is approximately 30 times larger than that which would be provided by the fastener head 30' alone. If a two-prong clip 20 is utilized, such as illustrated in FIG. 4, the width of the clip might be approximately one-half that of the four-prong clip 20 of FIG. 2. Accordingly, a surface area and bearing surface of about half that discussed above with respect to the four-prong clip 20 would result which would still be approximately 15 times larger than that which would be provided by the head 30' of the fastener 30 alone.

The finished insulated wall construction 10 may further include a layer of surface bonding cement 40 over the insulation boards 16 and clips 20 and fasteners 30 and this surface bonding cement layer 40 may in turn be covered by a finish coat layer 41 to complete an insulated outside wall construction. However, the insulated wall construction in accordance with this invention may be covered with other types of covering or not covered at all, as desired, and the coverings do not form part of the present invention.

In the drawings and specification, there has been set forth preferred embodiments of the invention, and although specific terms are employed, they are used in a generic and descriptive sense only and not for purposes of limitation.

What is claimed is:

1. In an insulated wall construction, the combination of:

a substrate defining a wall surface;

at least two compressible, foamed plastic, insulation boards having a compression strength of between approximately 10 to 60 psi and being of predetermined thickness and butted together along outside edges thereof and positioned over said wall surface of said substrate with one face of said insulation board contiguous to said wall surface of said substrate;

a plurality of clips each comprising a generally flat plate of non-corrosive material positioned with one flat face thereof contiguous to the other face of said insulation boards, some of said clips spanning the butted edges of said insulation boards and other of said clips positioned between the edges of each insulation board, each of said flat plates being of predetermined dimensions for providing a bearing surface having an area of at least 1 square inch against the compressible insulation boards, at least two prongs extending generally perpendicularly outwardly from the one face of each of said plates and being of a predetermined length less than the predetermined thickness of said insulation boards and partially penetrating said insulation boards for securing said clip to said insulation boards and for connecting said insulation boards through said clips spanning the butted edges, and a centrally positioned aperture in each of said plates, and elongate fasteners each having a head on one end thereof of approximately 5 times less surface area than said plate of said clip and of greater dimensions than said aperture in said plate, said fasteners being of a predetermined length at least ⅜ inch greater than the predetermined thickness of said insulation boards and each extending through respective ones said apertures and generally perpendicularly outwardly from the one face of said plate with said fastener head being retained on generally the other face of said plate, and said fasteners penetrating through said insulation boards and into said substrate for securing said insulation boards to said substrate while being restrained by said clip from undesired compression of said insulation boards.

2. In an insulated wall construction, as set forth in claim 1, in which each of said plates is constructed of galvanized sheet metal, and in which said prongs are formed from said plate and are generally triangular and cut along two sides thereof from said plate and bent outwardly from said plate along the third side which remains attached to said plate.

3. In an insulated wall construction, as set forth in claim 1, in which each of said plates of said clips is generally rectangular, and in which there are four of said prongs respectively positioned generally in corner portions of each of said plates.

4. In an insulated wall construction, as set forth in claim 1, in which each of said plates of said clips is generally rectangular, and in which there are two of said prongs respectively positioned outwardly of said aperture in each of said plates.

5. In an insulated wall construction, as set forth in claim 1, in which said substrate comprises spaced-apart wooden studs and sheathing covering said studs and defining said wall surface, in which said butted edges of said insulation boards are positioned over said studs, and in which said fasteners penetrate into said studs.

* * * * *